US010322732B1

(12) United States Patent
Stern et al.

(10) Patent No.: US 10,322,732 B1
(45) Date of Patent: Jun. 18, 2019

(54) COUPLER KNUCKLE, CORES AND METHOD OF PRODUCTION

(71) Applicant: Pennsy Corporation, West Chester, PA (US)

(72) Inventors: Aaron Stern, West Chester, PA (US); Zachary Brook, Leola, PA (US); Perry Levitt, West Chester, PA (US); Manuel Tavares, Doylestown, PA (US); Wayne Murphy, Pottstown, PA (US)

(73) Assignee: Pennsy Corporation, West Chester, PA (US)

( * ) Notice: Subject to any disclaimer, the term of this patent is extended or adjusted under 35 U.S.C. 154(b) by 544 days.

(21) Appl. No.: 14/938,367

(22) Filed: Nov. 11, 2015

(51) Int. Cl.
*B61G 3/06* (2006.01)

(52) U.S. Cl.
CPC ..... *B61G 3/06* (2013.01)

(58) Field of Classification Search
CPC ..... B61G 3/00–3/10
See application file for complete search history.

(56) References Cited

U.S. PATENT DOCUMENTS

| | | | | |
|---|---|---|---|---|
| 461,312 | A | 10/1891 | Brown | |
| 533,985 | A | 2/1895 | Brown | |
| 693,998 | A | 2/1902 | Brown | |
| 2,088,135 | A | 7/1937 | Johnson et al. | |
| 2,562,504 | A | 7/1951 | Metzger | |
| 2,688,412 | A | 9/1954 | Kulieke | |
| 2,689,051 | A | 9/1954 | Kayler | |
| 3,670,901 | A | 6/1972 | Metzger | |
| 3,722,708 | A | 3/1973 | Ion et al. | |
| 3,779,397 | A | 3/1973 | De Penti | |
| 3,853,228 | A | 12/1974 | Metzger | |
| 3,856,156 | A | 12/1974 | Metzger | |
| 4,024,958 | A | 5/1977 | Kaufhold | |
| 4,090,615 | A | 5/1978 | Martin | |
| 4,605,133 | A | 8/1986 | Altherr | |
| 4,645,085 | A | 2/1987 | Hanula et al. | |
| 5,582,307 | A * | 12/1996 | Hawthorne | B22C 9/02 213/109 |
| 5,878,897 | A | 3/1999 | Lazzaro et al. | |
| 5,900,082 | A | 5/1999 | Hewitt | |
| 5,954,212 | A * | 9/1999 | Beatty | B61G 3/04 213/109 |
| 6,129,227 | A * | 10/2000 | Openchowski | B61G 3/04 213/111 |
| 6,796,448 | B1 | 9/2004 | Wilt et al. | |
| 7,302,826 | B2 | 12/2007 | Yoon | |
| 7,302,994 | B2 * | 12/2007 | Mautino | B22C 9/02 164/137 |
| 7,337,826 | B2 | 3/2008 | Mautino et al. | |

(Continued)

*Primary Examiner* — Jason C Smith
(74) *Attorney, Agent, or Firm* — Bonini IP Law, LLC; Frank J. Bonini, Jr.

(57) ABSTRACT

An improved method of production of a coupler knuckle, a core assembly for production of a coupler knuckle, and coupler knuckle having an improved interior configuration for handling forces imparted on the knuckle and transferring said imparted forces through the knuckle and improving handling of linear force loads and their transmission. The knuckle interior has a force handling structure that includes spaced apart layers and cavities, with a cavity extending between the nose section and the tail section thereof.

27 Claims, 5 Drawing Sheets

(56) References Cited

U.S. PATENT DOCUMENTS

| | | | | |
|---|---|---|---|---|
| 8,196,762 | B2 * | 6/2012 | Smerecky | B22C 9/02 164/137 |
| 8,201,613 | B2 * | 6/2012 | Marchese | B61G 3/04 164/137 |
| 8,297,455 | B2 | 10/2012 | Smyth | |
| 8,302,790 | B2 | 11/2012 | Dumey | |
| 8,381,923 | B2 | 2/2013 | Smyth | |
| 8,485,371 | B2 | 7/2013 | Nibouar et al. | |
| 8,499,819 | B2 | 8/2013 | Nibouar et al. | |
| 8,631,952 | B2 | 1/2014 | Smerecky | |
| 8,646,631 | B2 | 2/2014 | Marchese et al. | |
| 2009/0289024 | A1 * | 11/2009 | Nibouar | B22C 9/10 213/75 R |
| 2011/0068077 | A1 * | 3/2011 | Smyth | B22C 9/04 213/155 |
| 2011/0168655 | A1 | 7/2011 | Nibouar et al. | |
| 2012/0037586 | A1 | 2/2012 | Dumey | |
| 2012/0217217 | A1 | 8/2012 | Smerecky | |
| 2013/0160962 | A1 | 6/2013 | Nibouar et al. | |

* cited by examiner

COUPLER KNUCKLE, CORES AND METHOD OF PRODUCTION

BACKGROUND OF THE INVENTION

1. Field of the Invention

The present invention relates to the field of coupler knuckles for use in coupling railroad cars and more particularly to an improved coupler knuckle and core assemblies for producing a coupler knuckle.

2. Brief Description of the Related Art

Railroad vehicles are generally connected together with couplers. Railroad couplers are typically constructed to railroad standards so that couplers used on railroad cars may be coupled together even if produced by different manufacturers. Common knuckles are American Association of Railroads ("AAR") Standard E and F type railroad car couplers, and, in particular, the knuckles used in these couplers.

In the typical operation of railway vehicles, each railway car or vehicle is provided with a coupler. The couplers generally are attached to a yoke mounted on the center sill of the railway car. Each coupler of a railway car is centrally located and faces a coupler of an adjacent car, which, when brought into engagement with each other, join the cars together. The couplers carry a pivotally mounted knuckle thereon. A knuckle is pivotally carried on a coupler. The knuckle operation is regulated with other components which may include a knuckle lock, knuckle thrower, and knuckle lock lift. These components function to secure the knuckle in different positions, where the knuckle is able to receive and engage with another knuckle of a coupler of an adjacent car, and where the knuckle is released to disengage from another knuckle. Releasing the knuckle from engagement may be accomplished by disengaging the knuckle lock (which usually is done with a tool that is removably positioned in the lock lift). The knuckle is held on the coupler and pivots between locked and unlocked positions.

Knuckles are often manufactured from cast steel, and the knuckle casting weighs approximately 84 lbs. The cast steel used is grade E, tensile strength 120,000 psi, yield strength of 100,000 psi, elongation of 14%, reduction of area 30%. One problem that has been encountered over time when the knuckle is in use is fatigue cracking. Cracks form in the knuckle, and eventually over time, lead to the failure of the knuckle. When the knuckle fails, it must be replaced. In some cases, a train consisting of a number of railway cars will carry one or two spare knuckles for use in the event a knuckle fails. However, the task of replacing a knuckle is difficult, and, depending on the length of the train (i.e., number of cars), the location of the failed knuckle, and the weather conditions (snow, rain, heat, etc.), a replacement knuckle, often weighing 80 pounds or more, must be carried from the car in which it is carried (such as a location at the front or rear of the train) to the car with the damaged knuckle. Train separations are not uncommon, and occur daily. There are about 100,000 train separations a year, or about 275 separations per day, which are considered to be a result of knuckle failure. There are also a number of instances where the knuckle cannot be replaced on the train, but, where the entire car with the damaged knuckle must be taken to a repair facility. In these instances, the car needs to be taken out of service.

Aside from being burdensome for the railway operators and personnel, knuckle failures also can be costly, requiring a train to be delayed or one or more cars taken out of service. The production of coupler knuckles typically involves the use of cores that are placed in a mold. The cores are masses of material that block the molten metal from an area of the mold when the knuckle casting is being produced. The cores define cavities in the knuckle that is produced. The front core of a knuckle is commonly referred to as the finger core. The finger core produces an internal cavity in the knuckle. Another core used to produce a knuckle is the rear core, often referred to as the kidney core. Traditional knuckles have been observed to fail at the front, or finger core portion of the knuckle, or at the kidney core or rear portion.

The core of the finished knuckle is generally seen as a cavity in the knuckle, where the core was positioned during the casting of the knuckle. It is the practice of a knuckle that is cast to cast the knuckle around a core. The common practice is to utilize a core within the casting, and then break the core apart when the knuckle has been cast. This practice, aside from being time consuming, generally requires precise positioning of the core, such as, in a jig, and that the core remain in position during the casting process. U.S. Pat. No. 2,688,412, issued on Sep. 7, 1954, to F. C. Kulieke, for a "Coupler Knuckle Casting", discloses cavities being formed in a knuckle casting using interlocking cores that are placed within the cope and drag mold sections.

Current methods used for forming knuckles have drawbacks and are known to produce failures in the final product when the core is misaligned or has shifted during the forming process.

There is a need for a process for producing a knuckle that may be done with improved precision and less waste, and for a knuckle having improved capabilities for handling forces and having improved strength or fatigue life.

In addition, there is a need for an improved knuckle that is able to handle force loads and is suitably resistant to cracking and failure.

SUMMARY OF THE INVENTION

An improved coupler knuckle and system, method and core assembly for production of a coupler knuckle are provided. The improved coupler knuckle is designed to facilitate handling of force loads transmitted to the coupler knuckle through components of the coupling system, the vehicle to which the coupler is associated, and other coupler knuckles (e.g., of an adjacent vehicle) that are in engagement with the coupler knuckle.

The coupler knuckle production method includes the use of cores to create cavities in the formed knuckle. According to a preferred method, the knuckle is produced by casting, using a mold, such as, for example, cope and drag sections, that close together around the cores, and into which molten metal may be introduced. The preferred method may produce the cores from materials typically used for core production, such as, for example, green sand or a resin. The core material is provided so that it may withstand the temperatures of the molten metal during the molding process (retaining its core shape when encountering the hot metal), but, after the molten metal has solidified, the cores can be broken apart (through vibrations, shaking, contact with a tool, or other suitable means) and allowed to exit the knuckle casting through the openings that are formed in the knuckle.

According to some preferred embodiments, the knuckle is constructed to locate openings for removal of the cores after the casting has taken place.

An improved core assembly is provided to produce a knuckle, including improved knuckles shown and described herein. The improved core assembly, preferably, includes a number of components, which may be connected to define cavities within the knuckle. The connected core assembly preferably may define a plurality of cavities that are interconnected, while, at the same time, providing planes of material that form the knuckle casting. According to some preferred embodiments, the core assembly is configured with a plurality of core pieces which are disposed at different relative heights to define cavities and planes of material within the knuckle casting.

It is an object of the invention to produce an improved coupler knuckle that has an interior construction to facilitate improved force handling and transmission of force loads through the knuckle, including from one end of the knuckle to the other.

It is another object of the invention to provide an improved knuckle and a process for producing an improved knuckle, where the knuckle has increased fatigue resistance and improved strength.

It is another object of the invention to produce a knuckle that has a plurality of spaced apart layers in the knuckle interior which are separated by cavities.

It is another object of the invention to accomplish any one or more of the above objects, where a knuckle has a horizontal cavity extending from the nose wall thereof through the body to the tail, and more preferably, where the cavity is formed to have at least one opening at the tail.

It is another object of the invention to accomplish any one or more of the above objects, where the knuckle cavities are defined by the cores, and where the mold parts into which the cores are placed (such as the mold cope and drag sections) define the exterior walls of the knuckle.

According to some preferred embodiments, the cores define a cavity within the tail section, pivot pin section, and nose section, including a flag hole.

According to some preferred embodiments, the cores include at least one central core that forms a continuous cavity through the tail section, pivot pin section, and nose section. According to some preferred embodiments, the central core may be used with one or more upper and lower cores. According to one embodiment, the central core and at least one upper core are used to form cavities in the knuckle produced using the cores. According to another embodiment, the central core and at least one lower core are used to form cavities in the knuckle produced using the cores.

According to a preferred embodiment, the cores include a central core which forms a continuous cavity through the tail, pivot pin, and nose sections, and at least one upper core that forms the pivot pin cavity section and nose cavity section, and at least one lower core that forms the pivot pin cavity section and nose cavity section.

According to another embodiment, a molding assembly is provided for producing a knuckle casting. The molding assembly includes a cope section and drag section, and cores positioned in the cope and drag sections, which, according to preferred embodiments, are secured within the mold sections with locking cores.

The knuckles produced from the cores and mold assembly may be made from any suitable metal. According to some preferred embodiments, the mold assembly is designed to receive molten metal, including ductile iron, which may be alloyed with other metals and elements. A knuckle casting is produced by admitting molten metal into the mold assembly. According to some preferred embodiments, the knuckle casting may be subjected to suitable austempering steps of heating and cooling. For example, knuckles formed from austempered ductile iron, alloys, and austempered steel and alloys, may be produced using the cores and mold assembly shown and described herein. Knuckles also may be produced using Grade E steel and the mold assembly to produce a casting These and other advantages are provided by the invention.

BRIEF DESCRIPTION OF THE DRAWING FIGURES

DETAILED DESCRIPTION OF THE PREFERRED EMBODIMENTS

Figure 1:
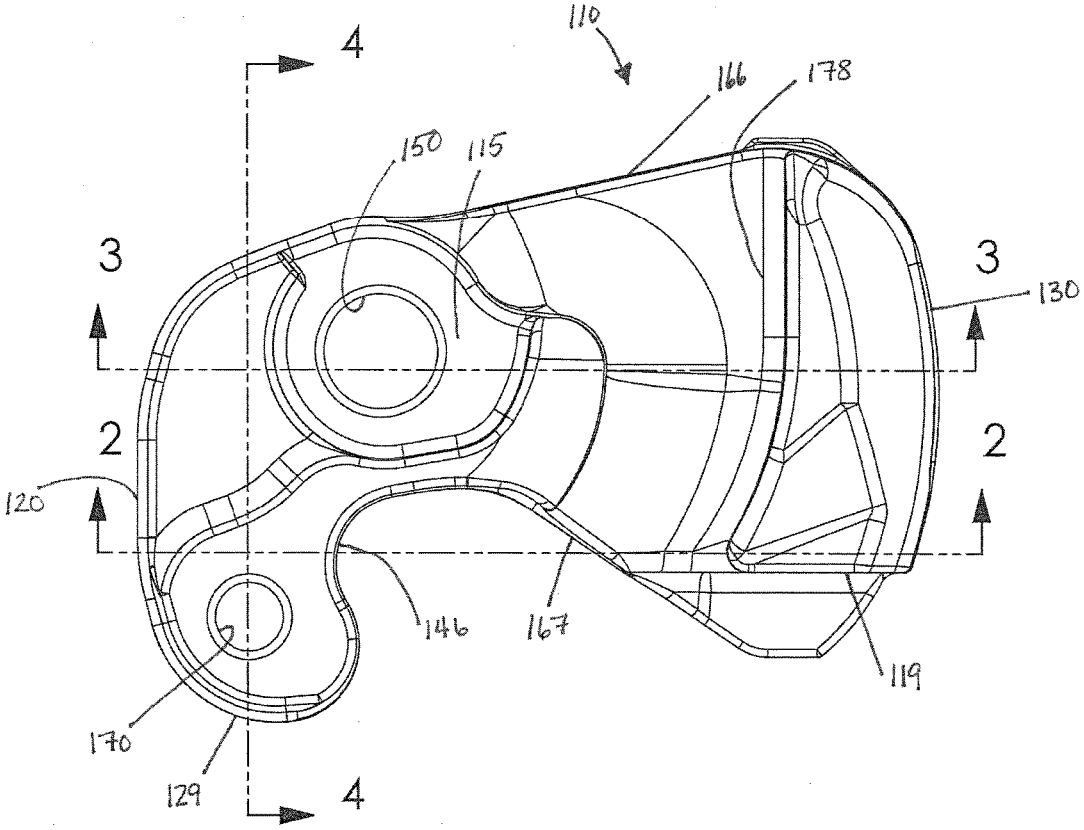
FIG. 1 is a top plan view of a knuckle constructed in accordance with the invention.

FIGS. 1-4 illustrate a preferred embodiment of a coupler knuckle 110 in accordance with the invention. The coupler knuckle 110 may be constructed using prior methods, or, preferably, from the method illustrated and described herein. The coupler knuckle 110, is illustrated in accordance with a preferred embodiment, and has an improved internal configuration for facilitating improved force handling. According to preferred embodiments, the knuckle 110 is configured to provide improved distribution of force loads through the knuckle in order to reduce stresses on the knuckle 110 and to improve resistance to fatigue.

The coupler knuckle 110 is illustrated including a force handling structure, which preferably has one or more transverse layers that span across the knuckle interior, and which are separated by cavities. Referring to FIGS. 1-4, the knuckle 110 is shown according to a preferred embodiment having a plurality of interior cavities, including nose cavities, such as the nose cavities 121,124, where the first or upper nose cavity 121 is on the interior of an upper wall 115, and where the second or lower nose cavity 124 is on the interior of the lower wall 118. A central or mid cavity 128 is provided and spans from the nose 120 of the knuckle to the tail 130. The mid cavity 128 is defined at the nose end by the nose wall 120*a*, and, is shown extending through the knuckle 110 and defining at the tail end thereof a tail or end cavity 128*a*. The mid cavity 128 is shown passing through the longitudinal pin bore or cavity 150, the mid cavity 128 being in communication with the pin bore cavity 150.

The knuckle 110 preferably is constructed with an improved force handling construction, which preferably, includes a plurality of layers that include the top wall or layer 115, the bottom wall or layer 118 and two mid layers, including the first mid layer 116 and second mid layer 117 which are separated by cavities therebetween, respectively, the first or upper cavity 121, second or lower cavity 124, and mid cavity 128. The layers include an upper layer 115 which is shown forming an upper surface of the top of the knuckle 110, and a lower layer 118 forming a lower surface of the bottom of the knuckle 110.

Figure 2:
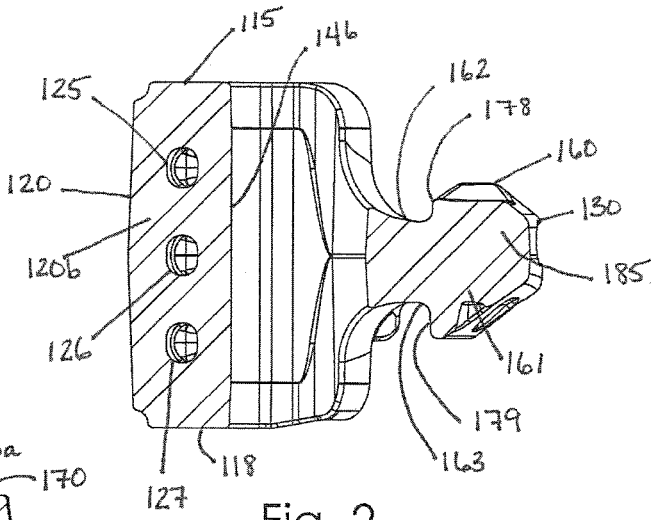
FIG. 2 is a sectional view taken along the section line 2-2 of FIG. 1.
Figure 4:
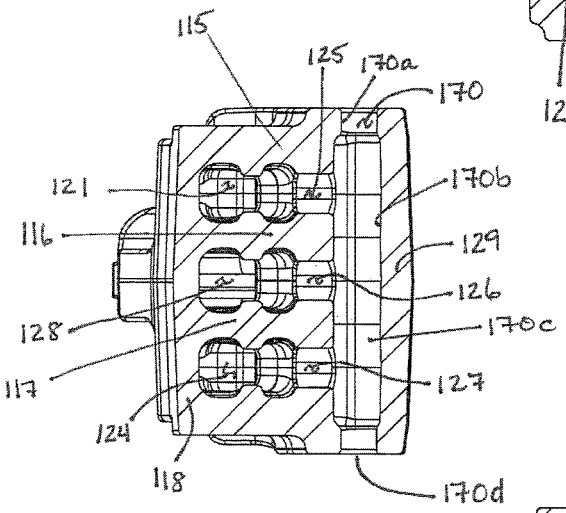
FIG. 4 is a sectional view taken along the section line 4-4 of FIG. 1.

As shown in FIG. 2, a section of the knuckle 110 is illustrated, a portion of which is taken through the front of the knuckle 110, the section passing through the throat wall 146 and nose 120. The nose wall 120*a* has an enlarged portion 120*b* shown forming a flag hole defining wall portion (although the section shown in FIG. 2 is taken beyond the location of the flag hole 170 in FIG. 1). A plurality of respective passageways or openings 125,126, 127 are formed in the wall portion 120*b* and extend into the flag hole 170 (see FIG. 4). The passageways 125,126,127 between the flag hole 170 and through the enlarged wall portion 120*c*, and communicate with the respective upper cavity 121, mid cavity 128, and lower cavity 124 (FIG. 4).

According to a preferred embodiment, the mid layers 116,117 are disposed for alignment in a direction of anticipated and expected pulling forces, when the knuckle 110 is employed on a railroad car coupling, and a pulling force is exerted on the knuckle 110.

Figure 3:
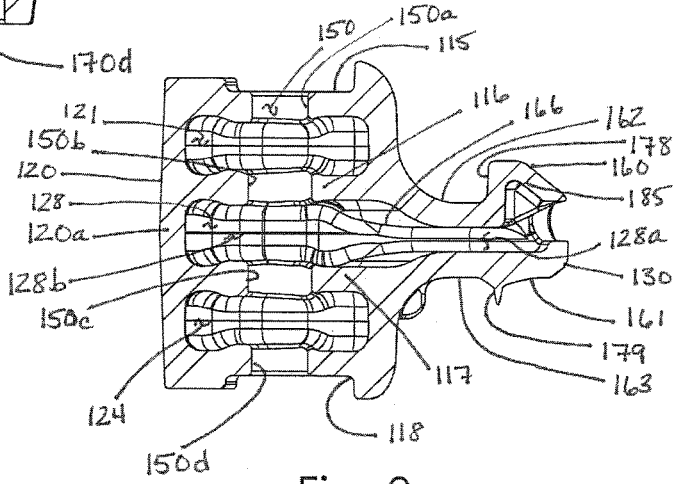
FIG. 3 is a sectional view taken along the section line 3-3 of FIG. 1.

Referring to FIG. 3, according to a preferred embodiment, the first mid layer 116 is shown disposed for alignment with the tail 130, and as shown in the preferred embodiment, with the upper lug 178 of the tail upper portion 160. The second mid layer 117 preferably is disposed for alignment with the tail lower portion 161, and in the preferred embodiment, is shown aligned with the lower lug 179. Preferably, the knuckle 110 includes an upper wall 162 and a lower wall 163 which preferably extend from the nose section 120 to the tail section 130. The tail section 130 includes a tail cavity 128*a* which is part of the mid cavity 128. The tail cavity 128*a* opens at the tail end of the knuckle 110. The tail cavity 128*a* communicates with the nose cavity 128*b* at the opposite or nose end of the knuckle 110. A first sidewall 166 (FIG. 3) and second sidewall 167 (FIG. 1) are provided between the nose portion 120 and tail portion 130, and are shown defining the sides of the mid cavity 128. The upper wall 115 and lower wall 118 along with the mid layers 116,117, according to a preferred configuration, are spaced apart and separate the cavities 121,128,124 in the knuckle, with adjacent layers defining a cavity therebetween.

The knuckle 110 has a pin bore 150 formed therein. As shown in FIG. 3, the pin bore 150 extends vertically through the nose area of the knuckle 110 and, in the embodiment illustrated, is formed in each of the spaced apart walls or layers 115,116,117,118, each respective layer being shown with a respective bore 150*a*,150*b*,150*c*,150*d*, provided therein. The bores 150*a*,150*b*,150*c*,150*d* are aligned to form a continuous pin bore 150 extending vertically through the knuckle 110. In the embodiment of the knuckle 110 illustrated, the cavities 124,128,121 are shown communicating with the pin bore 150. A flag hole 170 is provided in the knuckle 110 and, like the pin bore 150, preferably extends into and through the top layer 115 thereof. According to some preferred embodiments, the flag hole 170 may extend through the layers 115,116,117,118 and may be formed by a plurality of openings 170*a*,170*b*,170*c*,170*d* provided in the respective layers 115,116,117,118. According to some alternate embodiments, the flag hole 170 may extend to the lower layer 118, but not through it, and in other alternate embodiments, the flag hole 170 may extend into the bottom wall or layer 118 of the knuckle 110 without extending through it (e.g., such as, for example, into a recess of the interior of the bottom layer 118).

As shown in FIGS. 1, 2 and 3, pulling lugs 178,179 are provided on the tail 130. According to a preferred embodiment, the upper pulling lug 178 is provided at the tail upper portion 160 and is illustrated being transversely aligned in a pulling direction and being aligned with the first mid layer 116. The lower pulling lug 179 is provided at the tail lower portion 161 and is illustrated being transversely aligned in a pulling direction and being aligned with the second mid layer 117. The upper lug 178 is shown connected to the upper wall 162 and the lower lug 179 is shown connected to the lower wall 163. The upper and lower lugs 178,179, preferably are formed with the upper wall 162 and lower wall 163. According to the preferred embodiment illustrated, the upper lug 178 is shown spaced apart from the lower lug 179. The upper and lower lugs 178,179 are shown separated by the mid cavity 128. The coupler knuckle 110 also has a locking face 119 provided at the tail portion 130.

According to a preferred construction, the transverse layers 115,116,117,118 are provided along a path parallel to the anticipated force direction that the knuckle 110 handles when a pulling force is applied to the knuckle 110. The arrangement of the layers 115,116,117,118 of the knuckle 110 preferably allows force loads to be handled through the knuckle in preferred directions.

Figure 5:
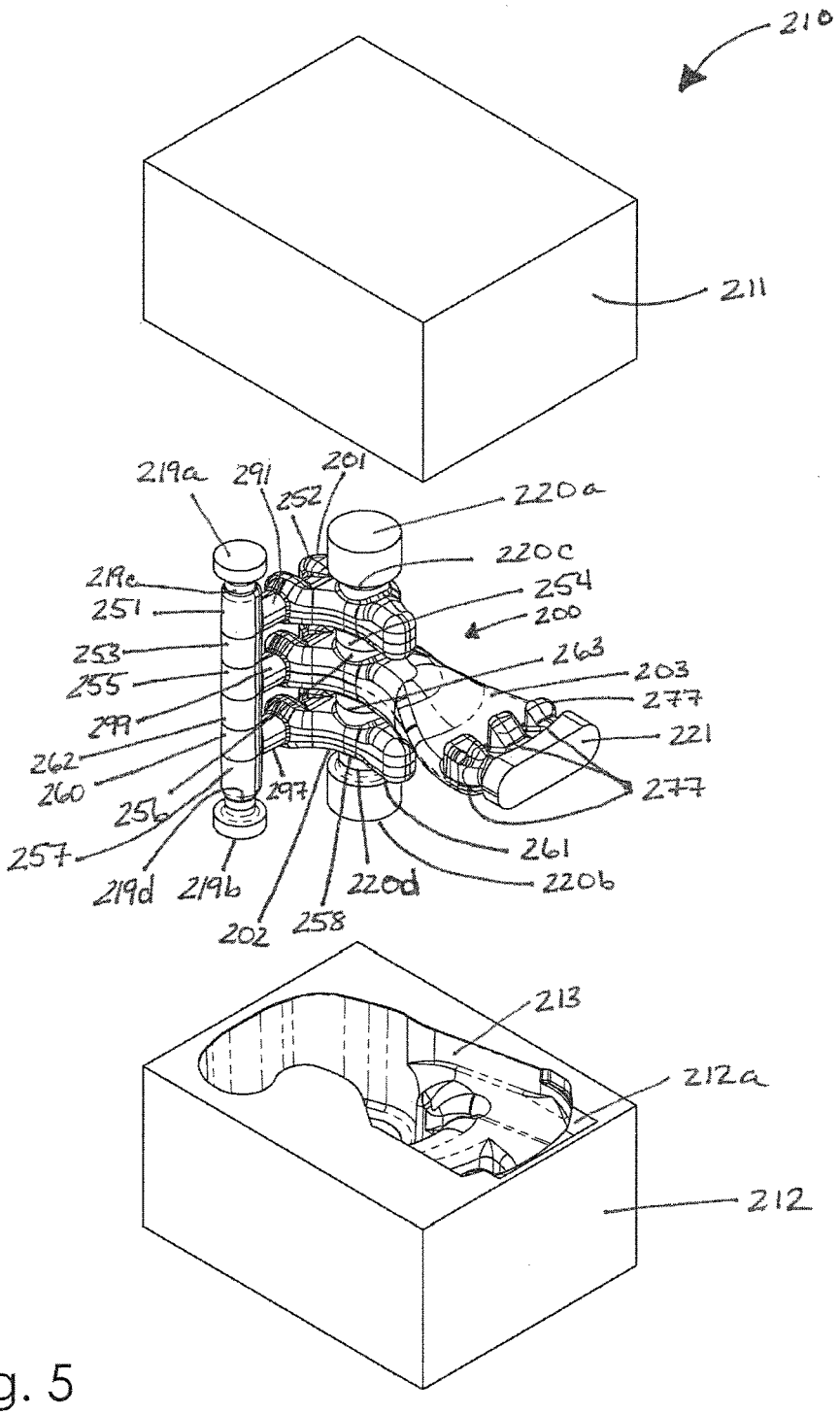
FIG. 5 is an exploded perspective view showing a preferred molding assembly for producing a knuckle, including cores shown in an assembled condition and cope and drag mold parts.

Referring to FIG. 5, a mold 210 comprised of mold components including a cope component 211 and drag component 212 is illustrated. A preferred embodiment of the cavities that would form in the knuckle 110 is shown through the illustration of the cores displayed in a preferred arrangement. Knuckle cavities are shown and identified by the reference numeral 200, which is the core assembly of core components. The drag component 212 of the mold 210 is shown having a mold cavity 213, and, while not shown, the cope component 211 also has a mold cavity. As illustrated in a preferred embodiment shown in FIG. 5, according to one configuration, in the case of the drag component 212, the mold cavity 213 corresponds to the shape or profile of the lower portion of the knuckle, whereas the mold cavity of the cope component 211 corresponds to the profile or shape of the knuckle upper portion (such as the knuckle 110 shown in the plan view of FIG. 1).

Figure 6:
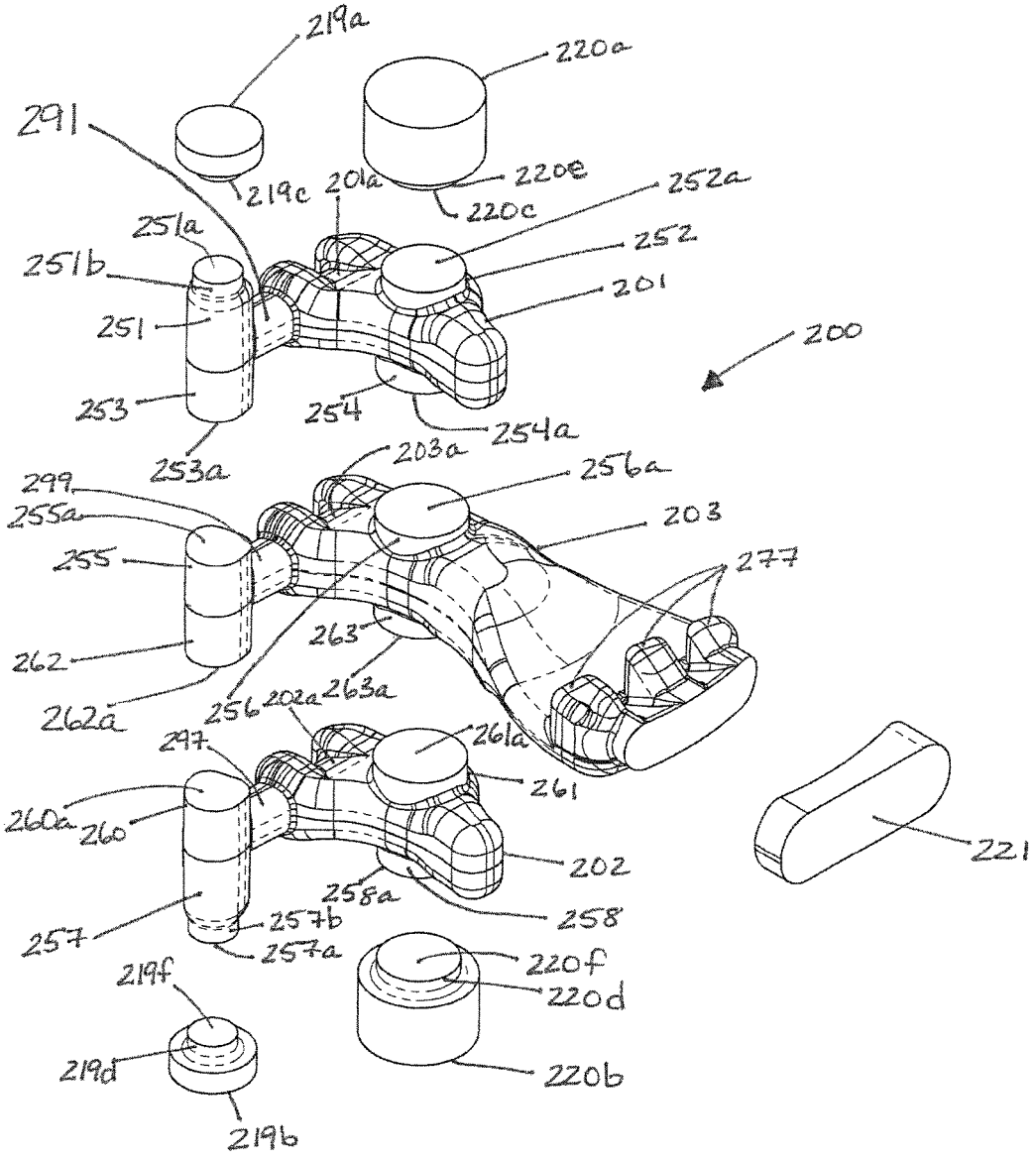
FIG. 6 is a perspective view illustrating a plurality of cores that may be used to form a knuckle.

According to a preferred embodiment, cavities within the knuckle 110 are formed from a plurality of cores. As shown in FIG. 6, according to a preferred embodiment, the plurality of cores include eight component cores, which include three internal core components (an upper core 201, lower core 202 and mid core 203) and locking core portions 219*a*,220*a*, 219*b*,220*b* and 221. The core components 201,202,203, (and in some embodiments, locking core portions 219*a*,220*a*, 219*b*,220*b*,221 that may connect thereto), when arranged together form the internal cavities of the knuckle 110 that is produced. The core components also form the pivot pin cavity or bore 150 and the flag hole 170 in the knuckle 110.

Figure 7:
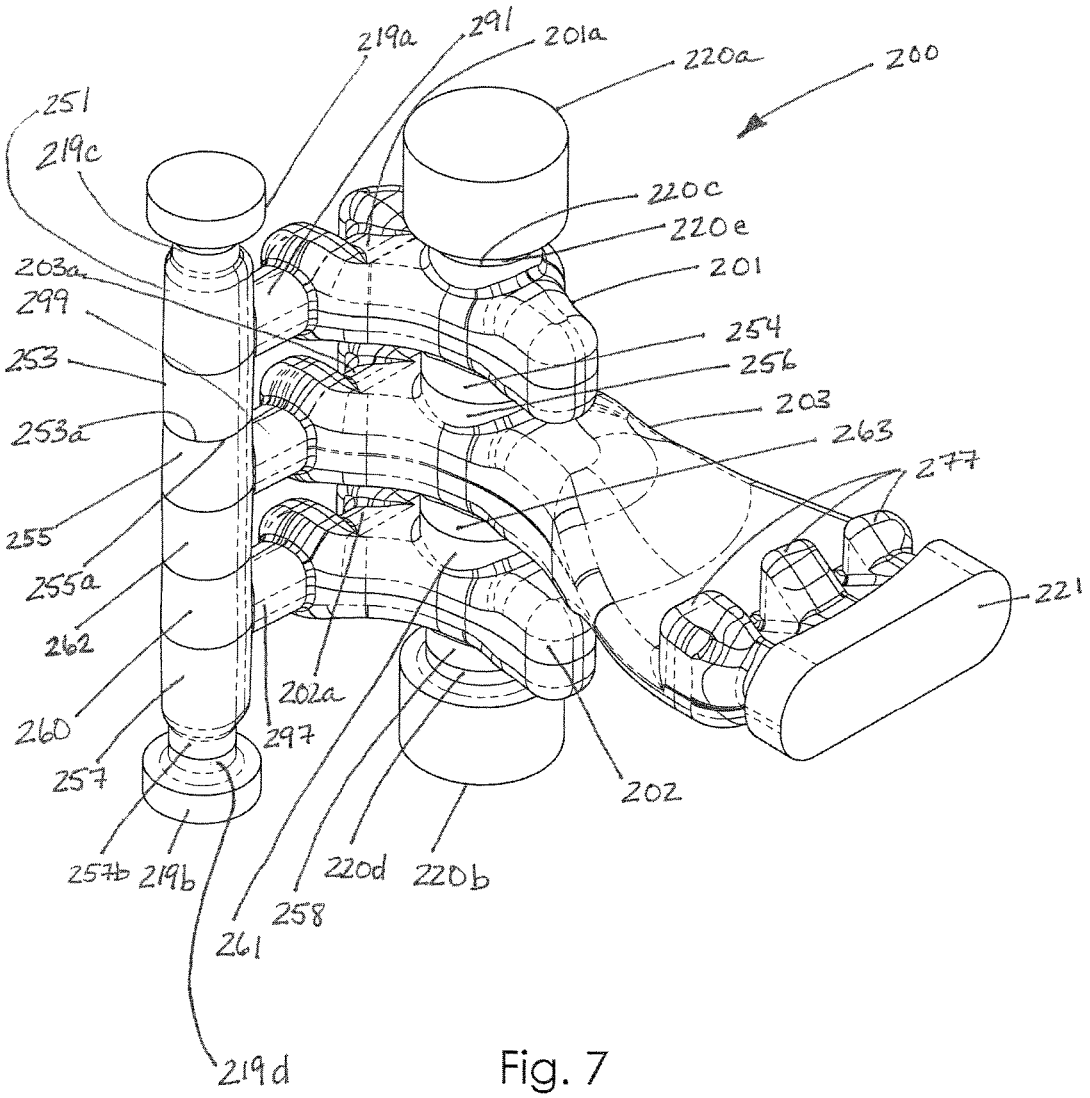
FIG. 7 is a perspective view of the cores of FIG. 6, shown engaging one another to form a representation of cavities in a knuckle casting produced from the cores, and of locking portions that may be used to lock the cores into respective sockets of the cope and drag mold parts.

Referring to FIGS. 6 and 7, the core assembly 200 is illustrated and preferably corresponds with the knuckle 110 and the cavities shown and described therein (see FIGS. 1-4). The core assembly 200 is shown comprising a plurality of cores, which according to a preferred embodiment includes an upper core component 201, lower core component 202, and mid core component 203.

According to a preferred embodiment, the core components 201,202,203, preferably are constructed with engaging surfaces formed on engaging lugs. According to some embodiments, the engaging surfaces may be matingly configured, such as, for example, being formed as draft surfaces. The upper core component 201 is shown with upper lugs 251,252 with respective engaging surfaces 251*a*,252*a*. The upper lug 251 is shown having an upper portion 251*b* on which the surface 251*a* is provided. The engaging surfaces 251*a*,252*a* of the respective upper lugs 251,252 engage with the respective engaging surfaces 219*c*,220*c* of the respective core components that are the locking core portions 219*a*, 220*a*. The upper core component 201 also has lower lugs 253,254 with respective engaging surfaces 253*a*,254*a* which engage the engaging surfaces 255*a*,256*a* of the respective upper lugs 255,256 of the mid core component 203. Although the upper core component lug is referred to as an upper lug 251 and a lower lug 253, they may comprise a single structure (as may the lugs 255,262 of the central core component 203, and lugs 257,260 of the lower core component 202). The lower core component 202 engages with the lower locking core portions 219*b*,220*b*. The lower core component lower lug 257 is shown including lower portion 257*b* which has an engaging surface 257*a* thereon. The engaging surfaces 257*a*,258*a* of the respective lower core component lower lugs 257,258 engage with the respective engaging surfaces 219*f*,220*f* of the respective locking core portions 219*b*,220*b*. The locking core portions 219*b*,220*b* may be the same as the locking core portions 219*a*,220*a* shown at the upper end of the core assembly 200. As illustrated in the drawings, the lower core component 202 includes upper lugs 260,261 with respective engaging surfaces 260*a*,261*a* which engage with the respective engaging surfaces 262*a*,263*a* of the respective mid core component lower lugs 262,263.

The core components forming the flag hole 170 of the knuckle 110 are shown including the upper core component 201, lower core component 202 and mid core component 203. Locking cores 219*a*,219*b* are shown with lug portions 219*c*,219*d* thereof, respectively, which preferably may form opposite ends of the flag cavity or flag hole 170. According to alternate embodiments, where the flag hole 170 of the knuckle 110 has a closed bottom, or is recessed at the lower layer or wall 118 thereof, the lower lug 257 of the lower core component 202 may form the bottom of the flag cavity. Alternatively, the lower lug 257 may be provided with an alternate configuration at the lower end thereof. Alternatively, the lower locking core portion 219*b* may be excluded from the assembly 200 to provide a flag hole configuration that does not extend through the knuckle lower layer 118, such as, for example, where the lower lug 257 of the lower core component 202 defines the bottom of the flag hole 170. With the locking core portion 219*b* omitted, a bore may not form at that location. According to some preferred embodiments, the lower core component 202 may be configured as a mirror image of the upper core component 201. Alternatively, where the flag hole 170 of a knuckle to be, produced is not to extend through the lower wall or layer 118 of the knuckle 110, the lower core component 202 may be a mirror image of the upper core component 201 in all respects (for example, where the locking core portion 219*b* is omitted), or, in come embodiments, in substantially all respects, (e.g., except for the lower lug 257 or portion thereof). According to some other embodiments, the lower core component 202 may be similar to the upper core component 210, but may have an alternate lower lug 257 (e.g., shorter) (as well as the omission of the locking core portion 219*b*).

According to an alternate embodiment, the upper and lower core components 201,202 are vertically aligned with each other. According to some preferred embodiments, the front portions of each of the upper, lower and mid core components 201,202,203 are vertically aligned with each other. A recess 201*a*,202*a*,203*a* may be provided in the front of each respective core component 201,202,203. Although shown on the upper portion of the core components, a recess also may be provided on the lower portion thereof.

A pivot pin bore or cavity 150 in the knuckle 110 is formed by the core assembly 200. As shown, according to a preferred embodiment, core components 201,202,203,220*a*, 220*b* are aligned to form a vertical pivot pin cavity in the knuckle 110 (corresponding with the cavity 150, FIG. 3). According to a preferred embodiment illustrated, the pin bore or cavity 150 in the knuckle 110 is formed by the, upper lug 252 and lower lug 254 of the upper core component 201, upper lug 256 and lower lug 263 of the mid core component 203, upper lug 261 and lower lug 258 of the lower core component 202, and locking core lug 220*d*. According to some embodiments, one or more portions of the pin bore 150 also may be formed by the lug 220*e* of the locking core 220*a*, and the lug 220*d* of the locking core 220*b*, or both.

According to a preferred embodiment, the upper core component 201 and lower core component 202 are shown including respective lateral lugs 251,253 and 257,260 and respective lateral or connecting core portions 291,297. Although the lugs 251,253 are referred to, they may be provided as a single component, as with the lugs 257,260 and lugs 255,262. The central core component 203 is illustrated including a lateral connecting core portion 299 that connects with one or more of the central lugs 255,262 defining a portion of the flag hole cavity 170 of the knuckle 110. The lateral core portions 291,299,297 form the respective passageways 125,126,127 in the knuckle 110 (FIG. 4) formed from the core assembly 200. The lugs 251,253,255, 262,260,257 align vertically to form the flag hole cavity that produces the flag hole 170 of the knuckle 110. According to preferred embodiments, the surfaces of the lugs, such as the surface 253*a* of lug 253, surface 255*a* of lug 255, surface 262*a* of lug 262, and surface 262*a* of lug 262, may be configured as draft surfaces. The draft surfaces of vertically adjacent lugs are matingly associated to fit together, as illustrated in FIG. 7, and, according to a preferred embodiment, may facilitate alignment of the respective core components 201,202,203 together in a preferred arrangement. According to some embodiments, the lug portions 251*b* and 257*b* of respective lugs 251,257, also may form a portion of the flag hole 170.

As shown in FIGS. 5, 6 and 7, according to a preferred embodiment, the central or mid core component 203 has spaced apart projections 277 thereon. The projections 277 define ribs, such as the ribs 185 shown in the knuckle 110 in FIGS. 2 and 3 (additional ribs, like those ribs 185, may be present in the knuckle 110 but are not shown in the sectional views). The projections 277 of the central core component 203 form the spacing between the ribs 185 of the knuckle 110 and thereby define the ribs at the tail by forming a contour of the knuckle interior (at the central cavity tail end 128*a*) with at least one or more of the mold cope 211 and drag 212 (see FIG. 5). An upper tail lug 178 of the knuckle 110 preferably may be formed by the upper mold part or cope 211, and the projections 277 define spaced apart ribs (e.g., 185) in the knuckle 110 formed from the core assembly 200. The ribs 185 preferably support the tail lug 178.

According to a preferred construction, the coupler knuckle 110 is made from a suitably strong material. One material is steel, and preferably grade E steel. According to some preferred embodiments, the coupler knuckle 110 is made from austempered metal, such as, for example, austempered ductile iron, austempered steel, as well as other austempered metals and austempered metal alloys. The coupler knuckle 110 made from austempered ductile iron (ADI) may be produced using a suitable austempering process. For example, austempering of ductile iron may be accomplished by heat-treating cast ductile iron to which specific amounts of nickel, manganese, molybdenum, or copper, magnesium or combinations thereof have been added to improve hardenability. Austempered steel and other austempered metals and austempered metal alloys, may be produced by any suitable austempering process. The knuckle may be cast, and then austempered.

According to one embodiment, the knuckle has improved fatigue-resistance and is lighter in weight than existing current knuckles. When constructing the coupler knuckle from an ADI having a specific gravity of about 0.26 lbs/in^3, the density is less than that of grade E cast steel, 0.283 lbs/in^3 and a weight reduction of about 8% may be achieved using the ADI to construct the knuckle 110 versus using grade E cast steel.

According to an alternate embodiment, the knuckle 110 may be constructed from austempered steel. Austempered steel is produced by a suitable austempering process. For example, austempering of steel may be accomplished by heat-treating cast steel to which specific amounts of chromium, magnesium, manganese, nickel, molybdenum, or copper, or combinations thereof, have been added to improve hardenability; the quantities of the elements needed to produce the austempered steel from the cast alloy steel are related to the knuckle configurations and, for example, may depend on the thickest cross-sectional area of the knuckle.

According to alternate embodiments, the knuckle 110 may be formed using a molding process where the molten material is added to a mold. According to one embodiment, the knuckle 110 is constructed by forming a wax casting, where the wax is coated with a suitable material that can receive the molten metal. The wax is then removed from the coating that becomes the mold, and molten material is then introduced into the coating. The material may be subject to a suitable austenitizing process to produce a knuckle made from austempered metal.

Alternatively, the knuckle 110 may be formed by an alternative process that involves constructing a mold that is the shape of the knuckle 110, where the mold is formed from a material that is designed to disintegrate when contacted with the molten material that is to form the knuckle 110. One example of a method for producing a knuckle is set forth in co-pending U.S. patent application Ser. No. 14/171,700, filed on Feb. 3, 2014, for a process for producing a coupler knuckle and improved coupler knuckle. One preferred method involves forming the mold that resembles the knuckle 110, where the mold has the same and shape and volume of the knuckle 110 to be produced. The mold may be formed using injection molding, three dimensional (3-D) printing or other suitable procedure. The mold resembling the knuckle 110 in shape and volume is then coated with a coating that covers the interior and exterior surfaces of the mold. The coating may be applied one or more times, and may be applied by brushing, spraying, immersing, or other suitable application process. The mold interior spaces that are to remain as cavities in the formed knuckle 110 preferably are filled with an inert material, such as sand. The material that is to form the knuckle 110 is then introduced into the mold to contact the disintegratable mold material forming the mold, and the molten metal occupies the space that the mold previously had. The mold coating, which is made from a material that does not melt or degrade when exposed to the molten metal, remains and contains the molten metal. According to this method, preferably, the mold that is within the coating disintegrates by decomposing to form by products, such as a gas that passes through the coating. Once the molten material used to form the knuckle 110 has been allowed to cure, then the knuckle 110 may be broken away from the coating to provide a formed product. The resultant knuckle formed may be subjected to an austempering process, such as, for example, where ductile iron (e.g., a ductile iron alloy) is the molten metal used for the casting, and a knuckle composed of ADI is formed therefrom.

Preferred methods for constructing the knuckle 110 involve the use of mold parts, such as, for example, cope and drag mold sections that may be brought together around cores (such as the core components). One preferred method for producing a knuckle involves preparing or providing a cope mold section 211, a drag mold section 212 and cores, such as the core assembly 200 of core components shown and described herein. The assembled mold parts receive molten metal (e.g., iron, steel or other alloy metal) which fills the spaces of the mold which represent the volume of the knuckle to be produced. The knuckle casting is allowed to solidify, and then core assembly of core components is separated from the knuckle 110. Preferred methods involve shaking or vibrating the knuckle to break apart the cores, or other ways of applying a force to the cores. The cores and core assembly 200 may be made from any suitable material, including green sand and/or resins. According to a preferred embodiment, the method involves the use of a core assembly made from material that will not melt or substantially degrade in the presence of the molten metal (at least not to any extent that would adversely affect the formation of the knuckle 110). Preferably, the cores and core assembly 200 include locking core portions that aid in securing the core assembly within the mold. According to preferred embodiments, mold cope and drag sections include corresponding recesses for receiving the locking core portions to hold the cores of the core assembly in place.

According to one preferred method, a coupler knuckle for a railcar is produced using mold components. As shown, in accordance with a preferred embodiment, referring to FIG. 5, a cope component 211 and drag component 212 are provided. The core components of the core assembly 200, shown in FIG. 6, form the knuckle cavities. The cope and drag mold portions 211,212 have internal walls that define perimeter boundaries of a coupler knuckle mold cavity 213. Preferably the cope component 211 also has an internal contour that defines the upper portion of the knuckle surface.

The method includes positioning a core assembly, such as, according to a preferred embodiment, the core assembly 200 of core components 201,202,203,219*a*,220*a*,219*b*,220*b*,221, within the mold, and preferably, within either the cope mold portion 211 or the drag mold portion 212. The core assembly 200 and cores thereof define the internal cavities of the coupler knuckle to be produced, and according to a preferred embodiment, includes a central core component 203 defining a mid or central cavity 128 of the coupler knuckle 110. The central cavity 128 encompasses cavities along the length of the knuckle 110, including the front of the knuckle 110 and the rear of the knuckle 110. Once the core assembly 200 of core components is positioned within the mold cope and drag, the cope and drag mold portions 211,212 are closed together with the core assembly 200 therebetween. The core assembly 200 and assembled core components 201,202,203,219*a*,220*a*,219*b*,220*b*,221 may be secured to the mold cope 211 and/or drag 212 in a desired portion by positioning locking portions of the respective cores into recesses of the cope 211 and drag 212. For example, according to a preferred embodiment, the central cavity end portion 128*a* defines an end of the coupler knuckle 110 that is the tail 130 of the knuckle. A tail locking portion 221 spans beyond the central core component 203 that defines the central cavity end portion 128*a* and beyond the knuckle 110. The tail locking portion 221 is shown connecting to the central core component 203. The tail locking portion 221 may be received in a recess (not shown) in the core 211 or drag 212 or both, such as, the recess 212*a* shown in the drag 212 (there also being a recess (not shown) in the core 211).

The cores or core components 201,202,203,219*a*,220*a*, 219*b*,220*b*,221 of the core assembly 200 produce cavities in the formed knuckle 110. The upper core component 201 forms an upper cavity 121, and, according to preferred embodiments, forms a portion of pivot pin bore 150. The lower core component 202 forms a lower cavity 124, and, according to preferred embodiments, forms a portion of the pivot pin bore 150. The central or mid core component 203 defines a central cavity 128.

The method involves positioning and assembling the core components so that the upper core component 201, lower core component 202, and mid core component 203 are arranged in a substantially parallel configuration to form substantially horizontal cavities in the knuckle 110. The upper core component 201, lower core component 202, and central core component 203 preferably may have a tapered configuration that widens as each core spans from at least its respective pin bore core portion to the front (toward the nose). According to some alternate embodiments, the central core component 203 and at least one of the upper core component 201 or lower core component 202 form a core assembly, which produces a knuckle having a central cavity, such as, for example, the cavity 128 of the knuckle 110, and at least one additional cavity, such as, for example, the upper cavity 121 or lower cavity 124.

Referring to FIG. 4, the nose area of the knuckle 110 is shown. As shown in a preferred embodiment, the knuckle 110 includes cavities 121,128,124 between layers, 115,116, 117,118. The cavities 121,128,124 extend into the area of the flag hole 170. The core components, such as, for example, lugs 251,253,255,262,260,257 which form the flag hole 170 in the knuckle 110 produced from the core assembly 200 of core components, are shown connecting with the upper, lower and mid core components 201,202,203, respectively, by way of the respective lateral or connecting cores 291, 297,299 (FIGS. 6 and 7). The lateral or connecting cores 291,297,299 preferably may connect to one or more lateral lugs of respective core component. The core components 201,202,203 are configured to extend into the nose area to define in the knuckle 110 a nose wall 120*a*. The exterior profile of the nose wall 120*a* preferably is formed by the mold cope 211 and drag 212 when molten metal introduced to fill the voids between the mold cope 211 and drag 212 and core assembly 200.

The molten metal, or melt as it is sometimes referred to, is introduced into the mold cavity now including the core assembly 200 of core components therein. The knuckle casting is formed within the mold cavity as the molten metal is allowed to solidify. When the knuckle is solidified, then the knuckle and mold are separated from each other. As shown in the knuckle 110 formed with the core assembly 200 of core components, a plurality of substantially parallel cavities 121,124,128 are formed in the coupler knuckle 110 (FIG. 3). The substantially parallel cores 201,202,203, define a plurality of transverse layers, such as, for example, the layers 116,117 (FIG. 4) in the knuckle 110.

According to some embodiments, the method may involve placing the mold components and core components in a jig to hold the components together.

The knuckle 110, while according to a preferred embodiment is formed using the core assembly of core components, may be formed using other suitable methods, such as, for example, lost foam, wax casting, and the like.

These and other advantages may be realized with the present invention. While the invention has been described with reference to specific embodiments, the description is illustrative and is not to be construed as limiting the scope of the invention. The knuckles according to the invention preferably also may be constructed to have improved surface finishes to provide higher fatigue strength. According to some alternate embodiments, a knuckle may be provided having a surface finish of 125-175 RMS. Knuckles according to the invention, such as the knuckle 110 shown and described herein, may be constructed with walls having any suitable wall thickness dimensions. According to some alternate embodiments, knuckles may be constructed having wall thicknesses from between about 0.25 in. and about 1.5 in., and, according to some other embodiments, from between about 0.25 in to 1.25 in. In addition, according to some preferred embodiments, the coupler knuckles according to the invention may be constructed having the advantages discussed herein and meet the AAR specification, M-216, or exceed it.

Although the knuckle has been described herein according to preferred embodiments being formed by casting and with the cores shown and described herein, according an alternate embodiments, the knuckle may be produced using other methods, including methods disclosed in our co-pending U.S. patent application Ser. No. 14/171,700, filed on Feb. 3, 2014, for a process for producing a coupler knuckle and improved coupler knuckle, the complete contents of which are herein incorporated by reference. Alternatively, in accordance with an alternate embodiment, the core assembly may be provided with the central core component and one of the upper or lower core components. This variation also may include extensions, preferably, of the central core component in the flag hole cavity core portion and pivot pin cavity core portion. Alternatively, the extended core portion may connect with a locking core, such as the locking cores shown and described herein that connect with an upper core component or lower core component. The lateral or connecting core portions connect with the lugs forming the flag hole cavity, and, accordingly, may connect at a location of the lug so as to connect with one or more of the lateral lugs of a core component. Various modifications and changes may occur to those skilled in the art without departing from the spirit and scope of the invention described herein and as defined by the appended claims.

What is claimed is:

1. An improved coupler knuckle having a nose section, a tail section, and a pivot pin section, having multiple internal cavities formed by cores, wherein at least one of said cores is located on a central horizontal plane, producing a first cavity in the formed knuckle extending uninterrupted through the nose, tail, and pivot pin sections; and at least one additional core located on a plane vertically offset from the central horizontal plane, producing a second cavity extending uninterrupted through the nose and pivot pin sections;

said knuckle having an opening in the tail, wherein said at least one first cavity formed therein communicates with said opening in said tail and comprises a mid cavity, and wherein said knuckle includes an upper cavity disposed above said mid cavity formed by said at least one additional core, and a lower cavity disposed below said mid cavity, said lower cavity formed by at least one other additional core.

2. The coupler knuckle of claim 1, including a pin bore having a vertical axis, wherein said at least one first cavity passes through the vertical axis of the pin bore.

3. The coupler knuckle of claim 1, said at least one first cavity being formed in said knuckle from said plurality of cores that define a plurality of transverse layers formed in the nose section, wherein said plurality of cores form at least two of said plurality of transverse layers that are spaced apart vertically to define part of said first cavity.

4. The coupler knuckle of claim 3, wherein said coupler knuckle includes force handling means for handling forces imparted on the knuckle and transferring said imparted forces through the knuckle, said force handling means comprising said plurality of spaced apart transverse layers passing through the nose section.

5. The coupler knuckle of claim 3, having an upper pulling lug and a lower pulling lug, the upper pulling lug and lower pulling lug being provided on the tail section, and each being provided along a transverse plane, wherein each of said at least two of said plurality of transverse layers is aligned with one of said transverse planes of said upper pulling lug and lower pulling lug.

6. The coupler knuckle of claim 3, including a pivot pin bore, wherein said pivot pin bore extends through a respective bore provided in each of said plurality of transverse layers formed in the nose section.

7. The coupler of claim 1, wherein said nose portion includes a nose wall which on one side thereof forms an exterior surface of the knuckle, said nose wall extending from said nose to said throat and defining a wall thickness between said nose and said throat, wherein said wall thickness includes a cavity therein configured as a flag hole, said flag hole being formed in said knuckle by the at least one core producing said central cavity and said at least one additional core producing said second cavity.

8. The coupler knuckle of claim 1, wherein said cores vertically oriented to one another are connected in the nose section of the knuckle for the purpose of producing a cavity configured as a flag hole.

9. The coupler knuckle of claim 1, wherein said cores vertically oriented to one another are connected in the pivot pin section of the knuckle for the purpose of producing a cavity configured as a pivot pin hole.

10. The coupler knuckle of claim 8, wherein said cores vertically oriented to one another are connected in the pivot pin section of the knuckle for the purpose of producing a cavity configured as a pivot pin hole.

11. The coupler knuckle of claim 1, said nose section including a nose wall, wherein said first cavity is a transverse cavity that extends from said nose wall to said tail section.

12. The coupler knuckle of claim 1, wherein said knuckle is constructed of austempered ductile iron.

13. The coupler knuckle of claim 1, wherein said knuckle is constructed of steel.

14. The coupler knuckle of claim 13, wherein said steel is railroad specification M-201 Grade E steel.

15. An improved coupler knuckle having a nose section, a tail section, and a pivot pin section, having multiple internal cavities formed by cores, wherein at least one of said cores is located on a central horizontal plane, producing a first cavity in the formed knuckle extending uninterrupted through the nose, tail, and pivot pin sections; and at least one additional core located on a plane vertically offset from the central horizontal plane, producing a second cavity extending uninterrupted through the nose and pivot pin sections;

wherein said nose portion includes a nose wall which on one side thereof forms an exterior surface of the knuckle, said nose wall extending from said nose to said throat and defining a wall thickness between said nose and said throat, wherein said wall thickness includes a cavity therein configured as a flag hole, said flag hole being formed in said knuckle by the at least one core producing said central cavity and said at least one additional core producing said second cavity; and wherein at least one passageway is provided between said first cavity and said cavity configured as a flag hole, and wherein at least one other passageway is provided between said second cavity and said cavity configured as a flag hole, said passageways being formed by said cores.

16. The coupler knuckle of claim 15, wherein a plurality of passageways are provided, including an upper passageway between said upper cavity and said flag hole, a lower passageway between said lower cavity and said flag hole and a mid passageway between said mid cavity and said flag hole, said passageways in said knuckle being formed from said cores.

17. An improved coupler knuckle having a nose section, a tail section, and a pivot pin section, having multiple internal cavities formed by cores, wherein at least one of said cores is located on a central horizontal plane, producing a first cavity in the formed knuckle extending uninterrupted through the nose, tail, and pivot pin sections; and at least one additional core located on a plane vertically offset from the central horizontal plane, producing a second cavity extending uninterrupted through the nose and pivot pin sections;

the knuckle being formed from said cores, wherein said cores are configured to allow molten material to form a plurality of transverse layers passing through the nose and pivot pin section, said transverse layers strengthening the knuckle for handling imparted forces.

18. The coupler knuckle of claim 17, wherein said transverse layers are provided along a path substantially parallel to the force load direction.

19. The coupler knuckle of claim 17, wherein said plurality of spaced apart transverse layers define an upper, middle, and lower cavity.

20. The coupler knuckle of claim 19, wherein said plurality of cavities are substantially parallel.

21. The coupler knuckle of claim 20, wherein said spaced apart layers are disposed in a parallel arrangement and are transversely aligned with the pulling areas of the knuckle tail.

22. The coupler knuckle of claim 21, said coupler knuckle having a nose section and a tail section, wherein said coupler knuckle has pulling lugs on the tail section.

23. The coupler knuckle of claim 22, wherein said coupler knuckle has pulling lugs on the tail section, and wherein each of said pulling lugs is aligned with at least one of said plurality of layers in a pulling direction.

24. An improved coupler knuckle having a nose section, a tail section, and a pivot pin section, having multiple internal cavities formed by cores, wherein at least one of said cores is located on a central horizontal plane, producing a first cavity in the formed knuckle extending uninterrupted through the nose, tail, and pivot pin sections; and at least one additional core located on a plane vertically offset from the central horizontal plane, producing a second cavity extending uninterrupted through the nose and pivot pin sections;

including an upper tail lug, and a plurality of internal reinforcing ribs in said upper tail lug, wherein said plurality of reinforcing ribs are spaced apart by a plurality of recesses projecting from said central cavity into said tail lug.

25. The coupler knuckle of claim 24, wherein said knuckle is constructed of austempered ductile iron.

26. The coupler knuckle of claim 24, wherein said knuckle is constructed of steel.

27. The coupler knuckle of claim 26, wherein said steel is railroad specification M-201 Grade E steel.

* * * * *